US008662301B2

(12) United States Patent
DuVal et al.

(10) Patent No.: US 8,662,301 B2
(45) **Date of Patent: *Mar. 4, 2014**

(54) ARRAY OF PARTICULAR TISSUE PRODUCTS

(75) Inventors: Larry Dean DuVal, Lebanon, OH (US); Connie Marie Roetker, Fairfield, OH (US); Gregory William Duritsch, West Harrison, IN (US); Susan Rogers Marmo, Mason, OH (US); Jennifer Lori Steeves-Kiss, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1520 days.

This patent is subject to a terminal disclaimer.

(21) Appl. No.: 11/899,227

(22) Filed: Sep. 5, 2007

(65) Prior Publication Data

US 2008/0202965 A1 Aug. 28, 2008

Related U.S. Application Data

(60) Provisional application No. 60/903,165, filed on Feb. 23, 2007.

(51) Int. Cl.
*B65D 85/16* (2006.01)
*D21F 11/00* (2006.01)

(52) U.S. Cl.
USPC ..... 206/459.5; 162/129; 162/158; 186/52; 206/494

(58) Field of Classification Search
USPC ..... 206/233, 440, 459.1, 459.5, 494; 162/109, 129, 158; 604/385.01–386; 40/312; 186/52
See application file for complete search history.

(56) References Cited

U.S. PATENT DOCUMENTS

| | | | | |
|---|---|---|---|---|
| 5,344,027 | A * | 9/1994 | Kaplan | 206/459.5 |
| 5,445,272 | A * | 8/1995 | Crisp | 206/459.5 |
| 6,162,329 | A * | 12/2000 | Vinson et al. | 162/158 |
| 6,821,387 | B2 * | 11/2004 | Hu | 162/129 |
| 7,029,121 | B2 | 4/2006 | Edwards | |
| 7,172,073 | B2 * | 2/2007 | Hanson | 206/459.5 |
| 2005/0033630 | A1 | 2/2005 | Kowalchuk | |
| 2005/0065492 | A1 * | 3/2005 | Cole et al. | 604/385.01 |
| 2005/0279579 | A1 * | 12/2005 | Milk et al. | 186/52 |
| 2006/0168914 | A1 | 8/2006 | Steeves-Kiss et al. | |
| 2006/0288619 | A1 | 12/2006 | Henke et al. | |
| 2007/0043615 | A1 | 2/2007 | Dahleh et al. | |
| 2007/0055573 | A1 | 3/2007 | Grell | |
| 2007/0061188 | A1 | 3/2007 | Sakemiller et al. | |
| 2007/0095706 | A1 | 5/2007 | Legault et al. | |
| 2007/0100692 | A1 | 5/2007 | Minifie et al. | |
| 2007/0156515 | A1 | 7/2007 | Hasselback et al. | |

FOREIGN PATENT DOCUMENTS

| | | | |
|---|---|---|---|
| WO | WO 2006/083591 | A1 | 8/2006 |
| WO | WO 2006/130284 | A1 | 12/2006 |

* cited by examiner

*Primary Examiner* — Bryon Gehman
(74) *Attorney, Agent, or Firm* — Wednesday G. Shipp; Betty J. Zea

(57) ABSTRACT

An array of tissue products, and a method for providing a consumer with a desired tissue product, the array having a first group comprising: a first tissue product; a first package comprising an indicium representing the intensive property for strength or absorbency; a second group comprising: a second tissue product; a second package comprising an indicium representing an intensive property for softness; a third group comprising: a third tissue product; a third package comprising an indicium representing an intensive property; wherein each package has the same source identifier; and wherein the Softness PSU of the second tissue product is greater than the Softness PSU of the first tissue product and of the third tissue product.

14 Claims, 1 Drawing Sheet

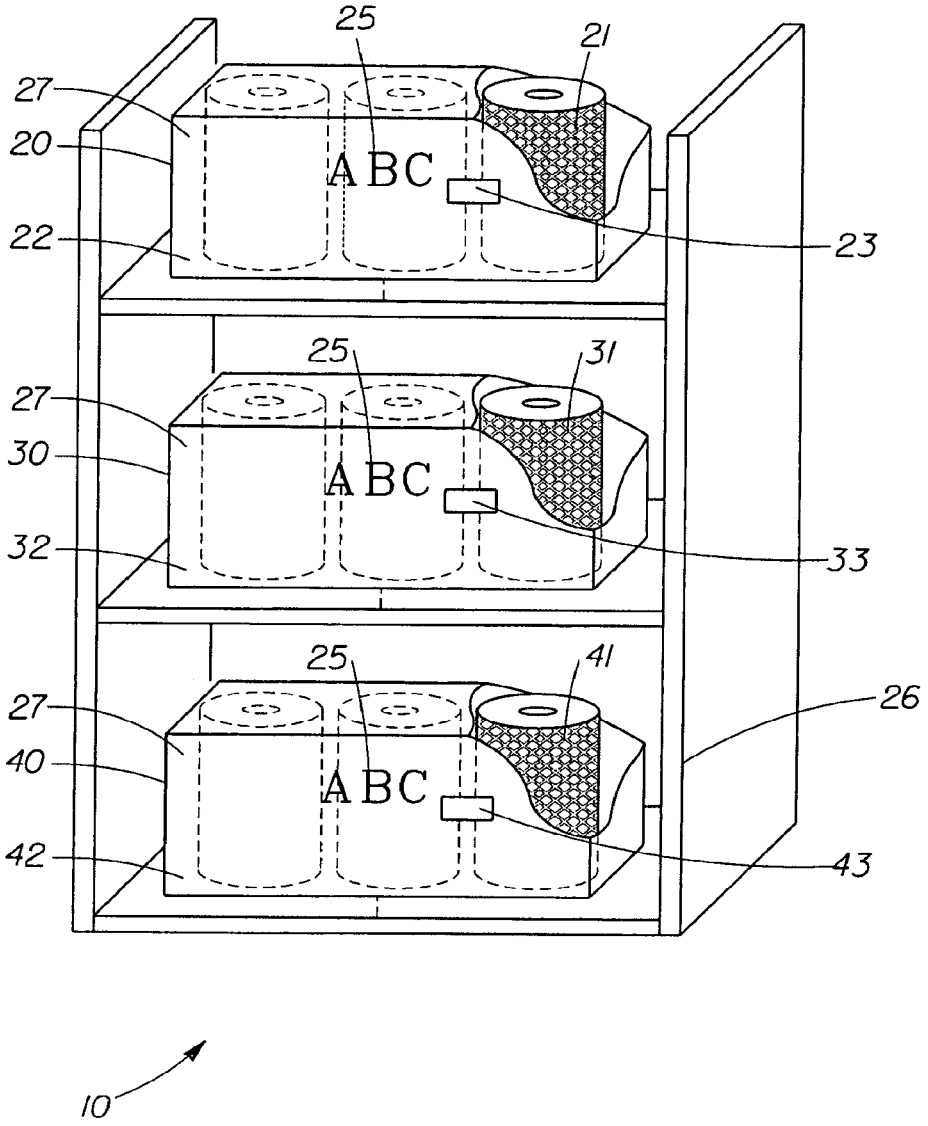
25
21
27
20
ABC
22
23
25
31
27
30
ABC
32
33
25
41
27
26
40
ABC
42
43
10

ARRAY OF PARTICULAR TISSUE PRODUCTS

CROSS REFERENCE TO RELATED APPLICATION

This application claims the benefit of U.S. Provisional Application No. 60/903,165 filed Feb. 23, 2007.

FIELD OF THE INVENTION

The present invention relates to an array of tissue products, and a method for providing a consumer with a desired tissue product.

BACKGROUND OF THE INVENTION

Paper products, used for paper towels, toilet tissue, facial tissue, napkins, and the like, are staples of everyday life. Consumers differ in their preferences for the attributes associated with these products. For example, some consumers desire a very strong product for maximum cleaning performance. These consumers desire a product useful for a variety of scrubbing and cleaning jobs around the kitchen such as for spills and tough countertop cleaning, and prefer a product that will not shred and that may be reused. Other consumers desire a paper towel product that provides sensory benefits, e.g. softness, cloth-like feel, pleasant scent, while being strong enough to function as a cleaning wipe. Others may even prefer a paper towel that represents a good value, offers the right amount of performance achievable, with less waste, at a moderate price.

Furthermore, it is believed that the longer it takes for a consumer to identify a product on the store shelf that will meet their needs, the less likely they will actually select the product for purchase while in the store. When it is difficult for the consumer to find their desired product in the retail store, the consumer is less likely to repurchase the product, even if the consumer has used and liked the performance of the product in the past.

Therefore, an array of tissue products is provided, and offers the consumer a greater opportunity to select the desired tissue product that will satisfy their needs. Accordingly, the array of sanitary tissue products provides that the product benefits are more readily and easily identified by the consumer.

SUMMARY OF THE INVENTION

An array of tissue products is provided, comprising a first group comprising: a first tissue product and a first package comprising an indicium representing the intensive property for strength or absorbency; a second group comprising: a second tissue product and a second package comprising an indicium representing an intensive property for softness; a third group comprising: a third tissue product and a third package comprising an indicium representing an intensive property; wherein each package has the same source identifier; and wherein the Softness PSU of the second tissue product is greater than the Softness PSU of the first tissue product and of the third tissue product.

BRIEF DESCRIPTION OF THE DRAWINGS

FIG. 1 is a schematic illustration of a tissue product array according to the present invention.

DETAILED DESCRIPTION OF THE INVENTION

Definitions

"Sanitary tissue product" or "tissue product" as used herein means a wiping implement for post-urinary and/or post-bowel movement cleaning (toilet tissue products), for otorhinolaryngological discharges (facial tissue products) and/or multi-functional absorbent and cleaning uses (absorbent towels such as paper towel products and/or wipe products). The sanitary tissue products of the present invention may comprise one or more fibrous structures and/or finished fibrous structures, traditionally, but not necessarily, comprising cellulose fibers. In one embodiment, the tissue products of the present invention include tissue-towel paper products.

A "tissue-towel paper product" refers to products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the layers may or may not be homogenous within a layer. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

The term "fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Basis Weight", as used herein, is the weight per unit area of a sample reported in lbs/3000 $ft^2$ or $g/m^2$.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Densified", as used herein, means that portion of a fibrous structure product that exhibits a greater density than another portion of the fibrous structure product.

"Non-densified", as used herein, means a portion of a fibrous structure product that exhibits a lesser density than another portion of the fibrous structure product.

"Array of tissue products" as used herein means a group of sanitary tissue products within a category such as paper towels, toilet tissue, facial tissue, wipes. In one embodiment, such a group of sanitary tissue products includes those sanitary tissue products that reside on the same shelf or on the same pallet in a retail store and/or in the same aisle in a retail store. For example, toilet tissue products are an array of sanitary tissue products, as are paper towel products.

"Visual proximity" refers to regions or items in a retail store that may all be viewed by a consumer standing in one location.

"Spatially separated" refers to regions or items in a retail store that are not in proximity to one another, such as might require a consumer to travel to a remote or different region of the store, or to exit one region such as an aisle, to reach the other region or item; adjoining regions of the store, such as on either side (i.e., facing sides) of an aisle, are not considered to be spatially separated; however, consecutive aisles would generally be considered to be spatially separated. Regions or items in a retail store that are spatially separated are not in visual proximity to one another.

"Retail Store" refers to a business that offers durable and/or disposable products such as tissue products for sale.

"Intensive property" as used herein means a property of a fibrous structure and/or sanitary tissue product, wherein the property is selected from the group consisting of: lint, softness, basis weight, texture, tensile strength, especially total dry tensile strength, absorbency and mixtures thereof.

"Common intensive property" as used herein means an intensive property that is present in two or more fibrous structures and/or sanitary tissue products.

"Value of an intensive property" as used herein means a measured value of an intensive property present in a sanitary tissue product.

"Dominant common intensive property" as used herein means the greatest of two or more values of a common intensive property. For example, if one sanitary tissue product exhibits a total dry tensile strength of about 650 g/in and another sanitary tissue product exhibits a total dry tensile strength of about 500 g/in, then the dominant common intensive property is the 650 g/in and the sanitary tissue product that exhibits a total dry tensile strength of about 650 g/in exhibits the dominant common intensive property. In other words, one of the sanitary tissue products exhibits greater total dry tensile strength than the other sanitary tissue product. In another example, if one sanitary tissue product exhibits a softness of about 0 psu and another sanitary tissue product exhibits a softness of +0.3 psu then the sanitary tissue product that exhibits a softness of about +0.3 psu exhibits the dominant common intensive property; namely softness. In other words, one of the sanitary tissue products is softer than the other sanitary tissue product. Relative values between sanitary tissue products, such as one sanitary tissue product is softer than another sanitary tissue product may be used to identify the dominant common intensive property in addition to the absolute values of common intensive properties.

In one example, in order for a common intensive property for strength of one sanitary tissue product to be a dominant common intensive property compared to another sanitary tissue product, the difference in the values of the common intensive properties for strength of the sanitary tissue products has to be greater than about 5% and/or greater than about 10% and/or greater than about 15% and/or greater than about 20% and/or greater than about 25% and/or greater than about 30% and/or greater than about 50%. In another embodiment the differences in the values of the common intensive properties of the tissue products is from about 5% to about 50%, in another embodiment greater than about 10% to about 45% or greater than about 20% to about 40%.

"Relative value of a common intensive property" as used herein means the value of a common intensive property of one fibrous structure and/or sanitary tissue product compared to the value of the common intensive property in another fibrous structure and/or sanitary tissue product. For example, the value of a common intensive property of one fibrous structure and/or sanitary tissue product may be greater or less than the value of the common intensive property of another fibrous structure and/or sanitary tissue product.

"Indicium" and/or "indicia" as used herein means an identifier and/or indicator and/or hint and/or suggestion, of the nature of a property of something, such as an intensive property of a sanitary tissue product.

"Dominant indicium" and/or "dominant indicia" as used herein means that a package and/or sanitary tissue product, itself, comprises only an indicium that communicates a single intensive property of a sanitary tissue product or that a package and/or sanitary tissue product, itself, comprises an indicium that communicates more than one intensive property of a sanitary tissue product wherein a consumer interprets the totality of the indicium as indicating that the sanitary tissue product exhibits a dominant intensive property. For example, a package may comprise only an indicium that communicates the intensive property of strength, such as total dry tensile strength, to a consumer so that strength would be the dominant indicium. In another example, a package may comprise the phrase "soft and strong" all in the same font and same color—there would be no dominant indicium based on this phrase. However, if the phrase was "soft and STRONG" where the word strong was somehow emphasized to stand out so that a consumer would interpret the dominant intensive property of the sanitary tissue product to be strength, such as total dry tensile strength, then strength or strong would be the dominant indicium.

"Dominant strength indicium" and/or "dominant strength indicia" as used herein means that strength, such as total dry tensile strength, is the dominant indicium.

"Textual indicium" and/or "textual indicia" as used herein means a text indicium, such as a word and/or phrase that communicates to a consumer a property about the sanitary tissue product it is associated with. In one example, a sanitary tissue product, such as a toilet or paper towel tissue product, is housed in a package comprising a textual indicium; namely, the word "Strong" or the word "Soft."

"Non-textual indicium" and/or non-textual indicia" as used herein means a non-text indicium that communicates to a consumer through a consumer's senses. In one example, a non-textual indicium may communicate, even intuitively communicate, to a consumer through sight (visual indicium), through touch (texture indicium) and/or through sound and/or through smell (scent indicium).

Nonlimiting examples of non-textual indicia include colors, textures, patterns, such as emboss patterns and/or emboss pattern images, character representations, action representations, and mixture thereof.

"Dry Tensile Strength" (or simply "Tensile Strength" as used herein) of a fibrous structure of the present invention and/or a sanitary tissue product comprising such fibrous structure is measured according to the Tensile Strength Test Method described herein.

"Softness" as used herein means the softness of a fibrous structure according to the present invention and/or a sanitary tissue product comprising such fibrous structure, which is determined according to a human panel evaluation wherein the softness of a test product is measured versus the softness of a control or other product. The resulting number is a relative measure of softness between the two fibrous structures and/or sanitary tissue products and is reported as PSU (Panel Score Unit). The softness is measured herein by the softness test method described in the Test Methods section herein.

"Absorbency" as used herein means the characteristic of a fibrous structure according to the present invention and/or a sanitary tissue product comprising such fibrous structure, which allows it to take up and retain fluids, particularly water and aqueous solutions and suspensions. Absorbency is measured herein by the Horizontal Full Sheet (HFS) test method described in the Test Methods section herein.

Tissue Products

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$. In another embodiment the tissue product is a paper towel product with a basis weight of between about 15 g/m$^2$ and about 45 g/m$^2$. In another embodiment the basis weight is about 20 g/m$^2$ to about 35 g/m$^2$; and in yet another embodiment the basis weight is about 23 g/m$^2$ to about 30 g/m$^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in).

In addition, the tissue products may exhibit a total dry tensile strength from about 550 g/in to about 3,000 g/in, and/or from about 800 g/in to about 2,400 g/in, and/or from about 1000 g/in to about 2,000 g/in.

In one embodiment the HFS of the tissue products is from about 5 gms/gm to about 35 gms/gm, and/or from about 10 gms/gm to about 20 gms/gm and/or about 12 gms/gm to about 25 gms/gm.

The sanitary tissue products of the present invention may be in any suitable form, such as in a roll, in individual sheets, in connected, but perforated sheets, in a folded or unfolded format.

Array of Sanitary Tissue Products

An array of tissue products according to the present invention may comprise three or more sanitary tissue products.

As shown in FIG. 1, in one embodiment, an array of tissue products 10 (displayed on a store shelf 26 for example) comprises a first group 20, a second group 30 and a third group 40. The first group 20 comprises a first tissue product 21 and a first package 22. The first package 22 comprises an indicium 23 which may represent the intensive property of strength. The second group 30 comprises a second tissue product 31 and a second package 32. The second package 32 comprises an indicium 33 which may represent the intensive property of softness. The third group 40 comprises a third tissue product 41 and a third package 42. The third package 42 comprises an indicium 43 which may represent an intensive property which may be selected from the group consisting of lint, softness, basis weight, texture, tensile strength, especially total dry tensile strength, absorbency and mixtures thereof.

The first tissue product 21 is housed within the first package 22 and exhibits a first value of intensive property for softness. The second tissue product 31 is housed within the second package 32, and exhibits a second value of intensive property for softness; and the third tissue product 41 is housed within the third package 42 and exhibits a third value of intensive property for softness, wherein the second value for softness is greater than the first value and the third value.

In another embodiment the second tissue product has a Softness PSU from about 0.3 PSU to about 4 PSU, in another embodiment from about 0.5 PSU to about 3 PSU and/or from about 1 PSU to about 2 PSU, greater than the Softness PSU of the first tissue product and the third tissue product. The softness values herein are represented by PSU and are measured by the softness test method described in the Test Methods section herein. In one embodiment the second tissue product 31 has a dominant common intensive property for softness relative to the first tissue product and the second tissue product.

In one embodiment the first tissue product comprise an HFS that is greater than the HFS of the second tissue product and/or the third tissue product. In another embodiment the HFS of the first tissue product is about 5% to about 45% greater than, and/or about 10% to about 40% greater than, the HFS of the second tissue product and/or the third tissue product.

The first package, second package and the third package comprise a source identifier 25 that may be identical.

In one embodiment the indicium 33 of the second package 32 is a dominant softness indicium, for example wording in larger font describing the intensive property of softness.

In one embodiment the indicium 23 of the first package 22 is a dominant strength indicium, for example wording in larger font describing the intensive property of strength.

The indicium 33, in one embodiment, may be matched to a dominant common intensive property present in the second tissue product. The indicium 23 may be matched to a dominant common intensive property present in the first sanitary tissue product, such as for example strength. In one example, the indicium 33 is different from the indicium 23.

In one embodiment, the third tissue product may be housed within a third package 42 that comprises an indicium 43 of an intensive property. The indicium 43 may be matched to an intensive property of the third sanitary tissue product 41. Further, the indicium 43 may be different from one or both indicia 33, 23.

Indicia may be either verbal or non-verbal. Nonlimiting examples of verbal indicia include text, such as brand names, which may be the same, separate, independent product designations that reinforce and/or support non-textual indicia present on the packages. For example non-textual indicia may include an emboss pattern and may be matched to an intensive properties of the first, second, third tissue products 21, 31, 41.

The first package 22, second package 32, third package 42 may be made from any suitable packaging material known in the art. Nonlimiting examples include polywrap, polymer films, such as polyolefin films, polyester films, paper, cardboard, plastic, wood, metal and other suitable packaging materials. In one example, first package 22, second package 32, third package 42 comprise the same material, in another embodiment comprises a polyolefin film, polyester film, cardboard, and mixtures thereof.

In addition to the indicium, the first, second, third packages 33, 32, 42 comprise a source identifier 25. The source identifier may be the same or may be identical, such as the use of the same brand names, trademarks, company name, etc. The source identifier is represented by "ABC" in FIG. 1. The source identifier 25 may be positioned anywhere on the first, second, third packages 33, 32, 42, or entirely or partially within the indicia 23, 33, 43, or may be discrete from the indicia 23, 33, 43.

As shown in FIG. 1, for example, first, second, third packages 22, 32, 42, comprise an outward facing surface 27 that is visible to the consumer at the point of sale in the retail store. In another embodiment the first, second and third tissue products 21, 31, 41, housed within the first, second, third packages 22, 32, 42, respectively, are visible to a consumer at the point of sale.

In another example, first, second, third packages 22, 32, 42, may comprise information about various roll sizes of the first, second and third tissue products 21, 31, 41, respectively.

In one example, an array of tissue products in accordance with the present invention may comprise a plurality of single- and/or multi-ply sanitary tissue products. The sanitary tissue products may come in a variety of roll sizes and may be packaged in different numbers of rolls, such as four, six, nine, twenty-four, and the like. The array of sanitary tissue packages may be displayed on a shelf at a point of sale, such as within a retail store, in such a way that the different sanitary tissue products or packages within the array are visible to a consumer during the consumer's purchasing decision process.

The array of sanitary tissue products of the present invention may comprise two or more multi-ply sanitary tissue products, such as two or more two-ply sanitary tissue products. The array may comprise at least one single-ply sanitary tissue product. The array may comprise a mixture of single-ply and multi-ply sanitary tissue products.

The array of sanitary tissue products may comprise two or more sanitary tissue products each of which comprises at least one value of a common intensive property that is different from at least one value of a common intensive property of one or more of the other tissue products.

The array of sanitary tissue products may comprise a single-ply sanitary tissue product that comprises at least one value of a common intensive property that is different from the value of a common intensive property of at least one multi-ply sanitary tissue product within the array of sanitary tissue products.

Tissue products within an array of sanitary tissue products may differ in price; for example, differ in retail price per package of equivalent roll count to a consumer. In one embodiment, the products of the third group comprise a lower price per package of equivalent roll count relative to the products of the first and second groups.

Method

Further, a method of providing a consumer with a desired tissue product is provided. The method comprises:

providing an array of tissue products comprising:

- a first group comprising:
  - a first tissue product and a first package comprising an indicium representing the intensive property for strength or absorbency;
- a second group comprising:
  - a second tissue product a second package comprising an indicium representing an intensive property for softness;
- a third group comprising:
  - a third tissue product and a third package comprising an indicium representing an intensive property;
- wherein each package has the same source identifier and the Softness PSU of the second tissue product is greater than the Softness PSU of the first tissue product and of the third tissue product; and arranging the first, second and third groups of the array in visual proximity to each other in the retail store.

In another embodiment, the first, second, and third groups are arranged in a stand-alone store display.

Nonlimiting examples of packages suitable for use with the sanitary tissue products of the present invention are commercially available from Cello-Foil Products, Inc. and Superpac.

Single or Multi-Ply Fibrous Structure or Tissue Product

The tissue products in the array herein may include paper towels, toilet tissue, facial tissue, napkins, and the like.

In one embodiment the fibrous structure or tissue product herein comprises from about 16% to about 40%, or about 23% to about 40% of hardwood fibers, in another embodiment from about 18% to about 35%, in yet another embodiment from about 25% to about 33%, of hardwood fibers, by weight of the fibrous structure or tissue product. In one embodiment the hardwood fiber are eucalyptus fibers.

In one embodiment, the fibrous structure or tissue product has a basis weight of from about 25 lbs/3000 $ft^2$ to about 50 lbs/3000 $ft^2$. In another embodiment the basis weight is about 20 lbs/3000 $ft^2$ to about 40 lbs/3000 $ft^2$; and in yet another embodiment the basis weight is about 22 lbs/3000 $ft^2$ and about 37 lbs/3000 $ft^2$; as measured by the Basis Weight Method described herein.

In one embodiment the present invention contemplates the use of a variety of paper making fibers, such as, natural fibers, synthetic fibers, as well as any other suitable fibers, starches, and combinations thereof. Paper making fibers useful in the present invention include cellulosic fibers commonly known as pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. In one embodiment the fibrous structure or tissue products comprise pulps derived from deciduous hardwood trees, and may be selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, Magnolia, and combinations thereof; in another embodiment Eucalyptus. Additionally, fibers derived from pulp such as cotton linters, Bagasse, Flax, Hemp, Kenaf, and combinations thereof, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded.

In one embodiment the paper is produced by forming a predominantly aqueous slurry comprising about 95% to about 99.9% water.

In one embodiment the non-aqueous component of the slurry, used to make the fibrous structure, comprises only eucalyptus and northern softwood kraft. The aqueous slurry is to be pumped to the headbox of the papermaking process.

In addition to the limitations disclosed herein, the fibrous structure product may comprise any tissue-towel paper product known in the industry. Embodiment of these substrates may be made according U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995, and U.S. Patent Application 2004/0192136A1 published in the name of Gusky et al. on Sep. 30, 2004.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Conventionally pressed tissue paper and methods for making such paper are known in the art, for example U.S. Pat. No. 6,547,928 issued to Barnholtz et al. on Apr. 15, 2003. Another suitable tissue paper is pattern densified tissue paper which is characterized by having a relatively high-bulk field of relatively low structure density, (which may be discrete and/or fully or partially interconnected) and an array of densified zones of relatively high structure density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field.

Processes for making pattern densified tissue webs are disclosed in U.S. Pat. No. 3,301,746, issued to Sanford, et al. on Jan. 31, 1967; U.S. Pat. No. 3,974,025, issued to Ayers on Aug. 10, 1976; U.S. Pat. No. 4,191,609, issued to on Mar. 4, 1980; and U.S. Pat. No. 4,637,859, issued to on Jan. 20, 1987; U.S. Pat. No. 3,301,746, issued to Sanford, et al. on Jan. 31, 1967; U.S. Pat. No. 3,821,068, issued to Salvucci, Jr. et al. on May 21, 1974; U.S. Pat. No. 3,974,025, issued to Ayers on Aug. 10, 1976; U.S. Pat. No. 3,573,164, issued to Friedberg, et al. on Mar. 30, 1971; U.S. Pat. No. 3,473,576, issued to Amneus on Oct. 21, 1969; U.S. Pat. No. 4,239,065, issued to Trokhan on Dec. 16, 1980; and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. et al. on May 21, 1974; and U.S. Pat. No. 4,208,459, issued to Henry E. Becker, et al. on Jun. 17, 1980. Uncreped tissue paper as defined in the art is also contemplated. The techniques to produce uncreped tissue in this manner are taught in the prior art; for example, Wendt, et al. in European Patent Application 0 677 612A2, published Oct. 18, 1995; Hyland, et al. in European Patent Application 0 617 164 A1, published Sep. 28, 1994; and Farrington, et al. in U.S. Pat. No. 5,656,132 issued Aug. 12, 1997.

Uncreped tissue paper, in one embodiment, refers to tissue paper which is non-compressively dried, in one embodiment, by through air drying. The techniques to produce uncreped tissue in this manner are taught in the prior art; for example, Wendt, et al. in European Patent Application 0 677 612A2, published Oct. 18, 1995; Hyland, et al. in European Patent Application 0 617 164 A1, published Sep. 28, 1994; and Farrington, et al. in U.S. Pat. No. 5,656,132 published Aug. 12, 1997.

Other materials are also intended to be within the scope of the present invention as long as they do not interfere or counteract any advantage presented by the instant invention.

The substrate which comprises the fibrous structure of the present invention may be cellulosic, or a combination of both cellulose and non-cellulose. The substrate may be conventionally dried using one or more press felts or through-air dried. If the substrate which comprises the paper according to the present invention is conventionally dried, it may be conventionally dried using a felt which applies a pattern to the paper as taught by commonly assigned U.S. Pat. No. 5,556,509 issued Sep. 17, 1996 to Trokhan et al. and PCT Application WO 96/00812 published Jan. 11, 1996 in the name of Trokhan et al. The substrate which comprises the paper according to the present invention may also be through air dried. A suitable through air dried substrate may be made according to commonly assigned U.S. Pat. No. 4,191,609; U.S. Pat. No. 4,239,065, issued Dec. 16, 1980, Trokhan and U.S. Pat. No. 3,905,863, issued Sep. 16, 1075, Ayres.

The fibrous structure product according to the present invention may be made according to commonly assigned U.S. Pat. No. 4,528,239 issued Jul. 9, 1985 to Trokhan; U.S. Pat. No. 4,529,480 issued Jul. 16, 1985 to Trokhan; U.S. Pat. No. 5,275,700 issued Jan. 4, 1994 to Trokhan; U.S. Pat. No. 5,364,504 issued Nov. 15, 1985 to Smurkoski et al.; U.S. Pat. No. 5,527,428 issued Jun. 18, 1996 to Trokhan et al.; U.S. Pat. No. 5,609,725 issued Mar. 11, 1997 to Van Phan; U.S. Pat. No. 5,679,222 issued Oct. 21, 1997 to Rasch et al.; U.S. Pat. No. 5,709,775 issued Jan. 20, 1995 to Trokhan et al.; U.S. Pat. No. 5,795,440 issued Aug. 18, 1998 to Ampulski et al.; U.S. Pat. No. 5,900,122 issued May 4, 1999 to Huston; U.S. Pat. No. 5,906,710 issued May 25, 1999 to Trokhan; U.S. Pat. No. 5,935,381 issued Aug. 10, 1999 to Trokhan et al.; and U.S. Pat. No. 5,938,893 issued Aug. 17, 1999 to Trokhan et al.

In one embodiment the tissue product is multiply, and the plies of the multi-ply fibrous structure may be the same substrate respectively or the plies may comprise different substrates combined to create desired consumer benefits. In one embodiment the fibrous structures comprise two plies of tissue substrate. In another embodiment the fibrous structure comprises a first ply, a second ply, and at least one inner ply.

In one embodiment of the present invention, the fibrous structure product has a plurality of embossments. In one embodiment the embossment pattern is applied only to one ply. In another embodiment the fibrous structure product is a two ply product wherein both plies comprise a plurality of embossments. In one embodiment the fibrous structure product comprises two or more plies of fibrous structure wherein at least one of the piles has a plurality of embossments thereon.

Suitable means of embossing include those disclosed in U.S. Pat. No. 3,323,983 issued to Palmer on Sep. 8, 1964; U.S. Pat. No. 5,468,323 issued to McNeil on Nov. 21, 1995; U.S. Pat. No. 5,693,406 issued to Wegele et al. on Dec. 2, 1997; U.S. Pat. No. 5,972,466 issued to Trokhan on Oct. 26, 1999; U.S. Pat. No. 6,030,690 issued to McNeil et al. on Feb. 29, 2000; and U.S. Pat. No. 6,086,715 issued to McNeil on July 11.

Suitable means of laminating the plies include but are not limited to those methods disclosed in commonly assigned U.S. Pat. No. 6,113,723 issued to McNeil et al. on Sep. 5, 2000; U.S. Pat. No. 6,086,715 issued to McNeil on Jul. 11, 2000; U.S. Pat. No. 5,972,466 issued to Trokhan on Oct. 26, 1999; U.S. Pat. No. 5,858,554 issued to Neal et al. on Jan. 12, 1999; U.S. Pat. No. 5,693,406 issued to Wegele et al. on Dec. 2, 1997; U.S. Pat. No. 5,468,323 issued to McNeil on Nov. 21, 1995; U.S. Pat. No. 5,294,475 issued to McNeil on Mar. 15, 1994.

The multi-ply fibrous structure product may be in roll form. When in roll form, the multi-ply fibrous structure product may be wound about a core or may be wound without a core.

Optional Ingredients

The fibrous structure or tissue product herein may optionally, in one embodiment, comprise one or more ingredients that may be added to the aqueous papermaking furnish or the embryonic web. These optional ingredients may be added to impart other desirable characteristics to the product or improve the papermaking process so long as they are compatible with the other components of the fibrous structure product and do not significantly and adversely affect the functional qualities of the present invention. In one embodiment the optional chemical ingredients include cationic charge biasing species; high surface area, high anionic charge microparticles for the purposes of improving formation, drainage, strength, and retention may also be included herein. See, for example, U.S. Pat. No. 5,221,435, issued to Smith on Jun. 22, 1993; cationic wet strength resins at a level of from about 2 to about 50 lbs./ton of dry paper fibers of the cationic wet strength resin in another embodiment from about 5 to about 30 lbs./ton; if enhanced absorbency is needed, surfactants may be used to treat the tissue product of the present invention, in one embodiment, from about 0.01% to about 2.0% by weight, based on the dry fiber weight of the tissue web; chemical softening agents; organo-reactive polydimethyl siloxane ingredients, including the amino functional polydimethyl siloxane, diorganopolysiloxane-based polymers; silicone gums, fluid diorganopolysiloxane polymers, etc., and mixtures thereof.

The chemical softening agents are generally useful at a level of from about 0.01% to about 15%, in another embodiment from about 0.1% to about 3%, and in another embodiment from about 0.2% to about 2% by weight of the fibrous structure product.

Filler materials may also be incorporated into the fibrous substrate products of the present invention. U.S. Pat. No. 5,611,890, issued to Vinson et al. on Mar. 18, 1997, discloses filled tissue-towel paper products that are acceptable as substrates for the present invention.

Test Methods

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room.

Tensile Strength Test Method:

One (1) inch by five (5) inch (2.5 cm×12.7 cm) strips of fibrous structure and/or sanitary tissue product are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

Softness Test Method (PSU):

Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The first tissue product is the zero base standard herein. The number of panel tests performed and averaged is such that about 0.2 PSU represents a significant difference in subjectively perceived softness.

Absorbency Test Method (Horizontal Full Sheet (HFS)):

The Horizontal Full Sheet (HFS) test method determines the amount of distilled water absorbed and retained by a sanitary tissue product of the present invention. This method is performed by first weighing a sample of the sanitary tissue product to be tested (referred to herein as the "Dry Weight of the paper"), then thoroughly wetting the sanitary tissue sample, draining the wetted sanitary tissue sample in a horizontal position and then reweighing (referred to herein as "Wet Weight of the paper"). The absorptive capacity of the sanitary tissue product sample is then computed as the amount of water retained in units of grams of water absorbed by the sanitary tissue product sample. When evaluating different sanitary tissue product samples, the same size of sanitary tissue product sample is used for all samples tested.

The apparatus for determining the HFS capacity of sanitary tissue product comprises the following: an electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sanitary tissue product tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The sanitary tissue product to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram of water per paper sample absorptive capacity of the sample (HFS value) is defined as (Wet Weight of the paper−Dry Weight of the paper).

All measurements referred to herein are made at 23±1° C. and 50% relative humidity, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of tissue products comprising:

a first group comprising:

a first tissue product and a first package comprising an indicium representing the intensive property for strength or absorbency wherein the first tissue product exhibits a total dry tensile strength from about 550 g/in to about 3,000 g/in and exhibits a HFS from about 5 gms/gm to about 35 gms/gm;

a second group comprising:

a second tissue product and a second package comprising an indicium representing an intensive property for softness;

a third group comprising:

a third tissue product and a third package comprising an indicium representing an intensive property;

wherein each package has the same source identifier and the Softness PSU of the second tissue product is greater than the Softness PSU of the first tissue product and of the third tissue product; wherein the first, second and third tissue products are paper towel products;

wherein the HFS of the first tissue product is about 5% to about 45% greater than the HFS of the second tissue product and the third tissue product or the first tissue product comprises a tensile strength that is about 10% to about 45% greater than the tensile strength of the second tissue product.

2. The array of claim 1 wherein the second tissue product has a Softness PSU of about 0.3 PSU to about 4.0 PSU greater than the Softness PSU of the first tissue product and of the third tissue product.

3. The array of claim 2 wherein the second tissue product has a Softness PSU of about 0.5 PSU to about 3.0 PSU greater than the Softness PSU of the first tissue product and of the third tissue product.

4. The array of claim 1 wherein the tensile strength of the first tissue product is about 20% to about 40% greater than the tensile strength of the second tissue product.

5. The array of claim 1 wherein the softness indicium of the second package is a dominant softness indicium.

6. The array of claim 5 wherein the strength indicium of the first package is a dominant strength indicium.

7. The array of claim 1 wherein the first package and the third package do not have an indicium representing the intensive property for softness.

8. The array of claim 1 wherein the first and second tissue products are 2-ply.

9. The array of claim 1 wherein the third tissue product is 1-ply.

10. The array of claim 1 wherein the third tissue product comprises a lower price per package of equivalent roll count relative to the first and second tissue products.

11. The array of claim 1 wherein the first tissue product comprises an HFS that is greater than the HFS of the second tissue product or the third tissue product.

12. The array of claim 1 wherein the third package comprises an indicium representing an intensive property selected from the group consisting of lint, softness, basis weight, texture, tensile strength, absorbency and mixtures thereof.

13. A method of providing a consumer with a desired tissue product comprising:

providing an array of tissue products comprising:

a first group comprising:

a first tissue product and a first package comprising an indicium representing the intensive property for strength or absorbency wherein the first tissue product exhibits a total dry tensile strength from about 550 g/in to about 3,000 g/in and exhibits a HFS from about 5 gms/gm to about 35 gms/gm;

a second group comprising:

a second tissue product a second package comprising an indicium representing an intensive property for softness;

a third group comprising:

a third tissue product and a third package comprising an indicium representing an intensive property;

wherein each package has the same source identifier and the Softness PSU of the second tissue product is greater than the Softness PSU of the first tissue product and of the third tissue product;

arranging the first, second and third groups of the array in visual proximity to each other;

wherein the first, second and third tissue products are paper towel products;

wherein the HFS of the first tissue product is about 5% to about 45% greater than the HFS of the second tissue product and the third tissue product or the first tissue product comprises a tensile strength that is about 10% to about 45% greater than the tensile strength of the second tissue product.

14. The method of claim 13 wherein the first, second, and third groups are arranged in a stand-alone store display.

* * * * *

UNITED STATES PATENT AND TRADEMARK OFFICE

CERTIFICATE OF CORRECTION

PATENT NO. : 8,662,301 B2
APPLICATION NO. : 11/899227
DATED : March 4, 2014
INVENTOR(S) : Dean Larry DuVal et al.

It is certified that error appears in the above-identified patent and that said Letters Patent is hereby corrected as shown below:

On the Title Page, item [75]

In Inventors, "Larry Dean DuVal" should be Dean Larry DuVal

Signed and Sealed this
Twenty-fourth Day of June, 2014

Michelle K. Lee

Michelle K. Lee
*Deputy Director of the United States Patent and Trademark Office*